US010232641B2

(12) United States Patent
Yamada

(10) Patent No.: US 10,232,641 B2
(45) Date of Patent: Mar. 19, 2019

(54) DRYING DEVICE AND LIQUID DISCHARGING DEVICE

(71) Applicant: Masafumi Yamada, Kanagawa (JP)

(72) Inventor: Masafumi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/459,154

(22) Filed: Mar. 15, 2017

(65) Prior Publication Data

US 2017/0266986 A1 Sep. 21, 2017

(30) Foreign Application Priority Data

Mar. 16, 2016 (JP) ..... 2016-053099

(51) Int. Cl.

| | |
|---|---|
| ***B41J 11/00*** | (2006.01) |
| ***B41J 3/60*** | (2006.01) |
| ***F26B 3/347*** | (2006.01) |
| ***H05B 6/60*** | (2006.01) |
| ***H05B 6/62*** | (2006.01) |
| ***F26B 3/34*** | (2006.01) |

(52) U.S. Cl.

CPC ..... *B41J 11/002* (2013.01); *B41J 3/60* (2013.01); *F26B 3/34* (2013.01); *F26B 3/347* (2013.01); *H05B 6/60* (2013.01); *H05B 6/62* (2013.01)

(58) Field of Classification Search

CPC ..... B41J 11/002; H05B 6/60; F26B 3/347

See application file for complete search history.

(56) References Cited

U.S. PATENT DOCUMENTS

| | | | | |
|---|---|---|---|---|
| 2,423,902 | A * | 7/1947 | Peterson | H05B 6/78 219/775 |
| 3,671,704 | A * | 6/1972 | Grassmann | H05B 6/60 219/775 |
| 4,257,167 | A * | 3/1981 | Grassman | D21F 5/00 219/775 |
| 4,506,452 | A * | 3/1985 | Lillibridge | F26B 15/08 118/620 |
| 5,162,629 | A * | 11/1992 | Erz | H05B 6/60 219/773 |
| 9,327,524 | B1 | 5/2016 | Yamada et al. | |
| 2003/0142187 | A1* | 7/2003 | Elgee | B41J 11/002 347/102 |
| 2005/0259981 | A1* | 11/2005 | Yip | B41J 11/002 392/417 |
| 2006/0082612 | A1 | 4/2006 | Morikawa et al. | |
| 2009/0225144 | A1* | 9/2009 | Kusunoki | B41J 2/14233 347/102 |

(Continued)

FOREIGN PATENT DOCUMENTS

| | | |
|---|---|---|
| JP | 2014-217989 | 11/2014 |
| JP | 2015-129902 | 7/2015 |
| JP | 2017-110837 A | 6/2017 |

*Primary Examiner* — Shelby L Fidler

(74) *Attorney, Agent, or Firm* — Oblon, McClelland, Maier & Neustadt, L.L.P.

(57) ABSTRACT

A drying device includes: a dielectric heating unit configured to apply an alternating electrical field to a medium onto which a liquid containing a conductive material, water, and a solvent has been discharged, and perform dielectric heating of the liquid; and a conductive member disposed either to make contact with or to be close to the medium to which the alternating electrical field is being applied.

11 Claims, 16 Drawing Sheets

(56) References Cited

U.S. PATENT DOCUMENTS

| | | | | |
|---|---|---|---|---|
| 2013/0119055 | A1* | 5/2013 | Wohl | H05B 6/50 219/774 |
| 2015/0328905 | A1* | 11/2015 | Regelsberger | B41J 15/005 347/104 |
| 2016/0114600 | A1 | 4/2016 | Yamada et al. | |

* cited by examiner

DRYING DEVICE AND LIQUID DISCHARGING DEVICE

CROSS-REFERENCE TO RELATED APPLICATIONS

The present application claims priority under 35 U.S.C. § 119 to Japanese Patent Application No. 2016-053099, filed on Mar. 16, 2016. The contents of which are incorporated herein by reference in their entirety.

BACKGROUND OF THE INVENTION

1. Field of the Invention

The present invention relates to a drying device and a liquid discharging device.

2. Description of the Related Art

With the advancement in the development of a line head in which main scanning of the ink nozzle is no more required, it has become possible to achieve high-speed inkjet printing. That has resulted in opening up of doors for implementing inkjet printing in high-speed machines, that is, in on-demand printing machines.

In a high-speed machine having inkjet printing implemented therein, if it is assumed that natural drying is adopted, then the speed of drying does not catch up with the printing speed. Thus, it becomes necessary to have a function for drying the ink. As far as a drying unit is concerned, a drying unit implementing high-frequency dielectric drying is known that can be built with a simple configuration.

However, in high-frequency dielectric drying, if an ink including conductive particles is used, it may result in anomalous heating or sparking. For example, in the case of drying a black ink having carbon black particles, when the carbon black particles make contact with each other as the drying goes on, they happen to exhibit conductive property in the image surface direction, which may result in anomalous heating or sparking. Moreover, for example, in the case of duplex printing, in the state in which one face (a first face) has been dried, when the other face (a second face) is dried, sparking may occur easily on the first face side even with only a small amount of electric power.

The present invention has been made in view of the issues described above, and it is an object of the present invention to provide a drying device and a liquid discharging device that, even in the case in which a liquid having a conductive material is discharged and then dried, enable drying without causing anomalous heating or sparking.

SUMMARY OF THE INVENTION

Brief Description of the Drawings

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
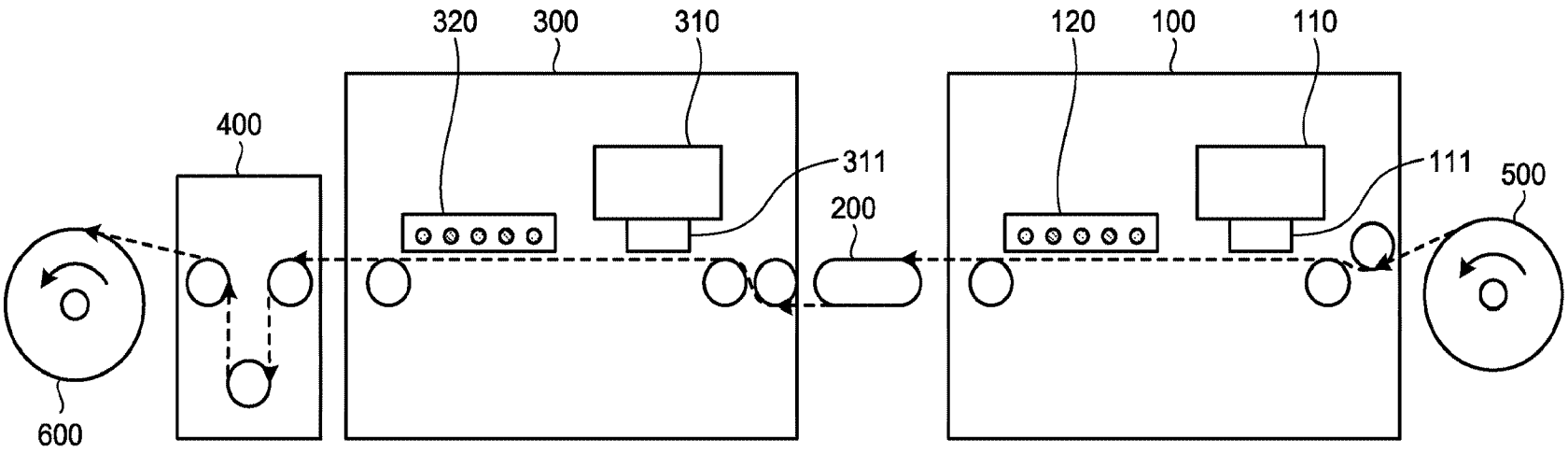
FIG. 1 is a block diagram illustrating an exemplary overall configuration of an image forming device according to a first embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

First Embodiment

Exemplary embodiments of a drying device and a liquid discharging device according to the present invention are described below in detail with reference to the accompanying drawings.

Herein, the "liquid discharging device" includes a liquid discharging head or a liquid discharging unit, and discharges a liquid by driving the liquid discharging head. The liquid discharging device not only indicates a device capable of discharging a liquid onto an object to which that liquid can get attached, but also indicates a device that discharges a liquid into air or into a liquid.

The "liquid discharging device" can include a unit to which a liquid can get attached but which is involved in feeding, conveyance, and paper ejection; and can also include a preprocessing device and a post-processing device.

For example, as the "liquid discharging device", an image forming device and a steric modeling device (a three-dimensional modeling device) are known. An image forming device discharges an ink and forms an image on a recording medium such as a paper sheet. A solid modeling device discharges a modeling liquid onto a powder layer formed by putting a powder in a layered manner, and models a solid modeled object (a three-dimensional modeled object).

Meanwhile, the "liquid discharging device" is not limited to a device in which meaningful images of characters or pictorial figures are visualized due to the discharged liquid. Alternatively, for example, the "liquid discharging device" can also indicate a device that forms patterns having no particular meaning themselves and a device that models three-dimensional images.

An "object to which a liquid can get attached" represents an object to which a liquid can get attached at least on a temporary basis; and either implies an object to which a liquid gets attached and remains adhered, or implies an object to which a liquid gets attached and permeates. The specific examples of such an object include a target paper for recording such as a paper sheet, a recording paper, a data sheet, a film, or a cloth; an electronic component such as an electronic substrate or a piezoelectric element; and a medium such as a powder layer (powdery layer), an organ model, and an examination cell. In this way, unless otherwise restricted, an "object to which a liquid can get attached" indicates any object to which a liquid can get attached.

Regarding the material of an "object to which a liquid can get attached", as long as a liquid can get attached to the material even on a temporary basis, it is possible to use any material such as a paper, a thread, a fiber, a fabric, leather, a metal, plastic, glass, wood, or ceramic.

Meanwhile, a "liquid" represents a liquid that has viscosity and surface tension and that can be discharged from a liquid discharging head; and is not restricted to any particular liquid. It is desirable that, under normal temperature and normal pressure, a "liquid" has the viscosity of 30 mPa·s or less when subjected to heating or cooling. Specific examples of the "liquid" include the following:

- a solvent such as water or an organic solvent
- a coloring agent such as a dye or a pigment
- a polymerizable compound, resin, or a liquid solution containing a functionality imparting material such as a surfactant
- a liquid solution containing a biocompatible material such as DNA, amino acid, protein, or calcium
- a liquid solution containing an edible material such as a natural coloring matter
- suspension
- emulsion Such liquids can be used, for example, in an inkjet ink, in a surface preparation liquid, in a liquid meant for formation of constituent elements of an electronic element or a light-emitting element or meant for formation of an electronic circuit register pattern, or in a material liquid meant for three-dimensional modeling.

Meanwhile, although the "liquid discharging device" indicates a device in which a liquid discharging head and an object to which the liquid can get attached move relative to each other, that is not the only possible case. As specific examples, the "liquid discharging device" indicates a serial type device that moves the liquid discharging head, and indicates a line type device that does not move the liquid discharging head.

Moreover, the "liquid discharging device" indicates a treatment liquid coating device that discharges a treatment liquid onto a paper sheet for coating the surface of the paper sheet with the treatment liquid so as to improve the quality of the surface of the paper sheet, and indicates an injection granulation device that injects a composition liquid, which is formed by dispersing raw materials in a liquid solution, via a nozzle and granulate fine particles of the raw materials.

In the "liquid discharging head", there is no limitation on a pressure generating unit to be used. For example, it is possible to use a pressure generating unit such as a piezo actuator (that may be using a laminated piezoelectric element); a thermal actuator that uses an electricity-heat converting element such as a heating resistor element; or a pressure generating unit such as an electrostatic actuator made of a vibration plate and an opposite electrode.

The "liquid discharging unit" is configured by integrating functional components and mechanisms with the liquid discharging head, and represents an assembly of components related to the discharging of a liquid. For example, the "liquid discharging unit" includes a unit in which at least one of a head tank, a carriage, a delivery mechanism, a maintenance-and-restoration mechanism, and a main-scanning movement mechanism is combined with the liquid discharging head.

Herein, integration implies that functional components and mechanisms are fixed to the liquid discharging heat by fastening, adhesion, or engagement; as well as implies holding one component in a movable manner with respect to another component. Moreover, the liquid discharging head can be kept detachably attachable with respect to the functional components and the mechanisms.

For example, a liquid discharging unit is known in which the liquid discharging head is integrated with a head tank. Moreover, a liquid discharging unit is known in which the liquid discharging head and a head tank are integrated by connecting them to each other using a tube. In such liquid discharging units, a unit including a filter can be added in between the head tank and the liquid discharging head.

Furthermore, a liquid discharging unit is known in which the liquid discharging head is integrated with a carriage.

Moreover, a liquid discharging unit is known in which the liquid discharging head is integrated with a scanning movement mechanism by holding the liquid discharging head in a movable manner on a guiding member constituting the scanning movement mechanism. Furthermore, a liquid discharging unit is known in which the liquid discharging head, a carriage, and a main-scanning movement mechanism are integrated with each other.

Moreover, a liquid discharging unit is known in which a cap member constituting a maintenance-and-restoration mechanism is fixed to a carriage to which the liquid discharging head is fit, and thus the liquid discharging head, the carriage; and the maintenance-and-restoration mechanism are integrated with each other.

Furthermore, a liquid discharging unit is known in which a tube is connected to the liquid discharging head to which a head tank or a flow passage component is fit; and thus the liquid discharging head and a delivery mechanism are integrated with each other. Through the tube, a liquid present in a liquid retainer is delivered to the liquid discharging head.

The main-scanning movement mechanism is assumed to include a lone guiding member too. Moreover, the delivery mechanism is assumed to include a lone tube and a lone loading unit too.

Meanwhile, in the present written description, the terms image formation, recording, typing, imaging, printing, and modeling are assumed to be equivalent terms.

The following explanation is given about an example in which a drying device and a liquid discharging device are implemented as an ink-jet image forming device that discharges an ink and forms images on a recording medium.

As described earlier, in inkjet printing, it is necessary to dry the ink. In a low-speed machine such as a personal device, although there are issues about the moistness of the paper attributed to the ink, natural drying of the ink does not lead to any critical issue. However, in a high-speed machine, if natural drying is adopted, the speed of drying does not catch up with the printing speed. Thus, if the printed materials are stacked after ejection; issues such as offset, blocking, and consequent color fading arise. For that reason, a high-speed machine performing inkjet printing needs to have a function for drying the ink.

The known examples of a drying unit include drum drying in which a drum is heated; radiational drying in which drying is performed using a halogen lamp or an infrared heater; and hot air drying in which hot air is blown. Such drying units are equivalent to the fixing process in electrophotography, and thus reduce the advantage of low energy consumption in the inkjet technology.

Herein, the ink represents the target for drying, and heating of components such as paper or rollers results in unnecessary energy consumption. As far as a unit for performing selective drying of only the ink is concerned, it is possible to think of a unit that makes use of the frictional loss of the dipoles of a dielectric substance having microwaves and high-frequency dielectrics. In such a unit, the calorific value is dependent on the electric permittivity and the tangent loss of the dielectric substance. Meanwhile, water has an enormously high calorific value. Hence, in a medium on which an image is formed using an ink, the medium is not heated and only the water content in the ink is heated. Moreover, since it is only the amount of heat used in heating that represents the power loss in a high-frequency electrical field, it becomes decisively advantageous as far as energy efficiency is concerned.

The wavelength range of microwaves has a greater tangent loss of water than the wavelength range of high-frequency dielectrics, and hence heating of a high energy density becomes possible. However, since there are issues like microwave leakage and heating unevenness, in a printing machine in which mediums move in and out in a continuous manner, configuring a drying device using microwaves makes the configuration complicated and also leads to an increase in the cost. In comparison, using high-frequency dielectrics, a drying unit can be built with a simple configuration, and hence is used in a printing-and-drying device.

In high-frequency dielectrics, it is necessary to take into account an ink containing conductive particles, such as a black ink containing carbon black particles described earlier. Since the carbon black is excellent as a component of a pigment from the perspective of concentration, texture, and chromogenic nature; it is commonly used in black inks.

The carbon black does not exhibit conductivity when dispersed in an ink. However, in a solid image of black color, when the drying goes on for a while and the carbon black particles make contact with each other, they exhibit conductivity in the image surface direction. In the high-frequency dielectric heating method, although a conductive material is heated, the presence of the conductive material itself may lead to anomalous heating or sparking attributed to the resistance value of the conductive material. Thus, if a solid image of a black ink containing carbon black particles is heated using high-frequency dielectric heating, the image may get burned. Moreover, as described earlier, in duplex printing, if the second face is dried after drying the first face, sparking is likely to occur easily on the first face side even with only a small amount of electric power.

In that regard, in a first embodiment, at the time of drying the first face that is the first of the two faces to be dried, the drying operation is controlled to stop the drying just before an increase in the conductivity. For example, the drying operation is so controlled that the liquid that has been discharged onto the first face has the percentage of a solvent equal to or greater than a threshold value. As a result, even if a liquid containing a conductive material is used, drying can be performed without causing anomalous heating or sparking. Meanwhile, the method according to the first embodiment can not only be implemented in a configuration in which a liquid is discharged onto both faces but can also be implemented in a configuration in which a liquid is discharged onto only one face (the first face). In that case, it becomes possible to curb anomalous heating at the time of drying the liquid that has been discharged on the concerned face.

FIG. 1 is a block diagram illustrating an exemplary overall configuration of an image forming device according to the first embodiment. As illustrated in FIG. 1, the image forming device includes a first image forming unit 100, an inverting unit 200, a second image forming unit 300, an auxiliary drying unit 400, a paper feeding roll 500, and a wind-up roll 600.

The image forming device illustrated in FIG. 1 is an example of a high-speed machine in which a line head is used. Herein, a medium of the continuous stationary type is conveyed in a roll-to-roll manner moving from the right-hand side to the left-hand side with reference to FIG. 1 (from the paper feeding roll 500 toward the wind-up roll 600). Meanwhile, it is also possible to have a configuration in which a medium other than the continuous stationary type is used. Herein, the configuration is such that a medium is conveyed along the first image forming unit 100, the inverting unit 200, the second image forming unit 300, and the auxiliary drying unit 400 in that order; and a duplex-printing image can be formed on the medium.

The first image forming unit 100 performs image formation on a first face representing one of the two faces of the medium. The second image forming unit 300 performs image formation on a second face representing the other face of the two faces of the medium. The first image forming unit 100 includes an inkjet image forming unit 110, and includes a first dielectric heating unit 120 at the downstream side of the inkjet image forming unit 110. The second image forming unit 300 includes an inkjet image forming unit 310, and includes a second dielectric heating unit 320 at the downstream side of the inkjet image forming unit 310. The first dielectric heating unit 120 applies a high-frequency electrical field (an alternating electrical field) from the side of the first face for the purpose of drying the ink present on the first face. The second dielectric heating unit 320 applies a high-frequency electrical field from the side of the second face for the purpose of drying the ink present on the second face.

The inkjet image forming units 110 and 310 form images on the conveyed medium according to the inkjet method. The inkjet image forming units 110 and 310 include liquid discharging heads 111 and 311, respectively, for discharging the ink. Alternatively, instead of using the liquid discharging head 111 (the liquid discharging head 311), it is possible to use a liquid discharging unit in which the liquid discharging head 111 (the liquid discharging head 311) is integrated with functional components and mechanisms.

Herein, the ink represents an example of a liquid containing a conductive material, water, and a solvent. For example, the ink can be a black ink containing carbon black particles, water, and a solvent. However, the ink containing a conductive material is not limited to a black ink containing carbon black particles. For example, the first embodiment can be implemented even in the case of using a magnetic ink or using an ink that has an arbitrary color (black color or a color other than black) and that contains a conductive material other than carbon black particles.

The first dielectric heating unit 120 dries the first face of the medium. In the configuration illustrated in FIG. 1, since the ink is initially discharged on the first face from among the two faces, the first dielectric heating unit 120 dries the medium in which the ink has been discharged only on the first face but not on the second face. The second dielectric heating unit 320 dries the second face of the medium.

Meanwhile, the first dielectric heating unit 120 and the second dielectric heating unit 320 can dry a medium using either microwave heating or high-frequency dielectric heating. In microwave heating, bandwidths in the vicinity of 915 MHz, 2.45 GHz, and 5.8 GHz are used as ISM bands (ISM stands for Industry-Science-Medical). In high-frequency dielectric heating, bandwidths in the vicinity of 13 MHz, 27 MHz, and 40 MHz are used. However, if it is possible to hold down the radio wave leakage level to the statutory value or below, any arbitrary frequency band in the vicinity of the abovementioned bandwidths can be used. As a result of such a configuration, drying is performed immediately after image formation, and hence medium conveyance in the post-processing becomes easier. Meanwhile, the following explanation is given about an example in which the first dielectric heating unit 120 and the second dielectric heating unit 320 perform high-frequency dielectric heating.

Figure 2:
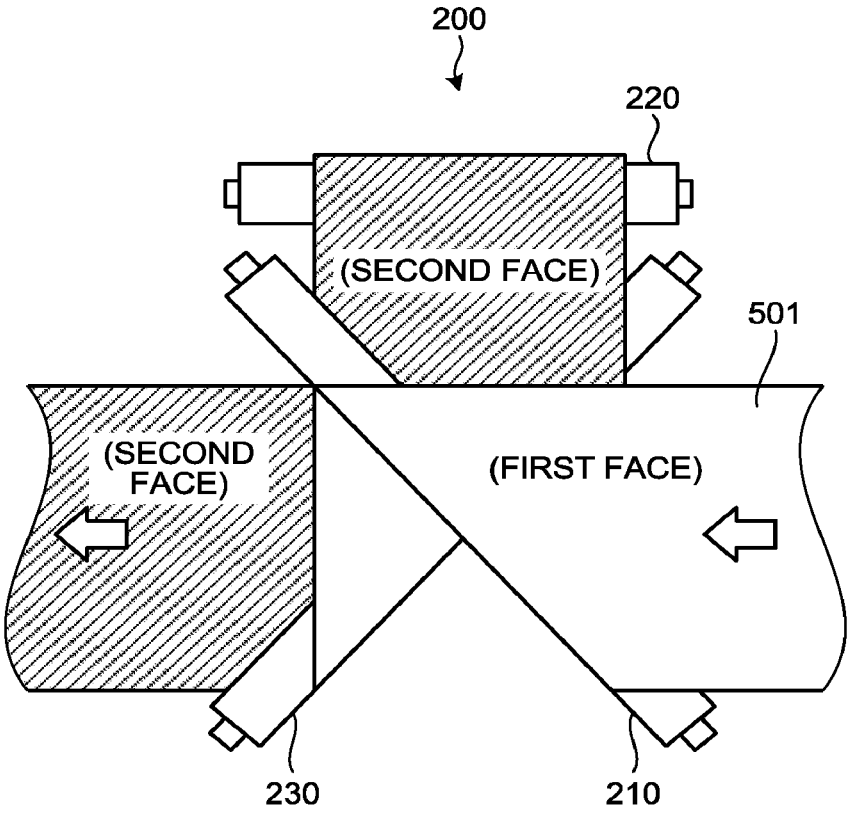
FIG. 2 is a diagram illustrating an exemplary configuration of an inverting unit.

The inverting unit 200 inverts the front and back of a medium. For example, using three rollers, the inverting unit 200 inverts the front and back of a medium of the continuous stationary type. As illustrated in FIG. 2, the inverting unit 200 includes rollers 210, 220, and 230. Herein, it is assumed that a medium 501 is conveyed from the right-hand side with reference to FIG. 2 (from the side of the first image forming unit 100 illustrated in FIG. 1).

If drying performed by the first image forming unit 100 is incomplete, then there is a risk that the roller 220, which abuts against the face on which an image is formed (with reference to FIG. 2, the first face), has taint deposited thereon due to ink transfer. Hence, it is desirable that a roller having the surface material of high releasability is used as the roller 220. Thus, a roller capable of discharging air for achieving contactless conveyance can be used as the roller 220.

Returning to the explanation with reference to FIG. 1, the auxiliary drying unit 400 dries the ink that could not completely dried during high-frequency dielectric heating (performed by the first dielectric heating unit 120 and the second dielectric heating unit 320). The high-frequency dielectric heating is excellent at drying the water but is ill-suited for drying the solvent. For that reason, the auxiliary drying unit 400 is used to completely dry the solvent. In the auxiliary drying unit 400, drying can be performed using a heat drum, heated air, or infrared light. As a result of the drying performed by the auxiliary drying unit 400, it becomes possible to avoid blocking when the medium is wound up in a rolled state.

As a result of having the configuration illustrated in FIG. 1, a duplex-printing image is formed after the operations such as formation of an image on the first face, drying of the image on the first face, inversion of the medium, formation of an image on the second face, drying of the image on the second face, and finish drying.

Figure 3:
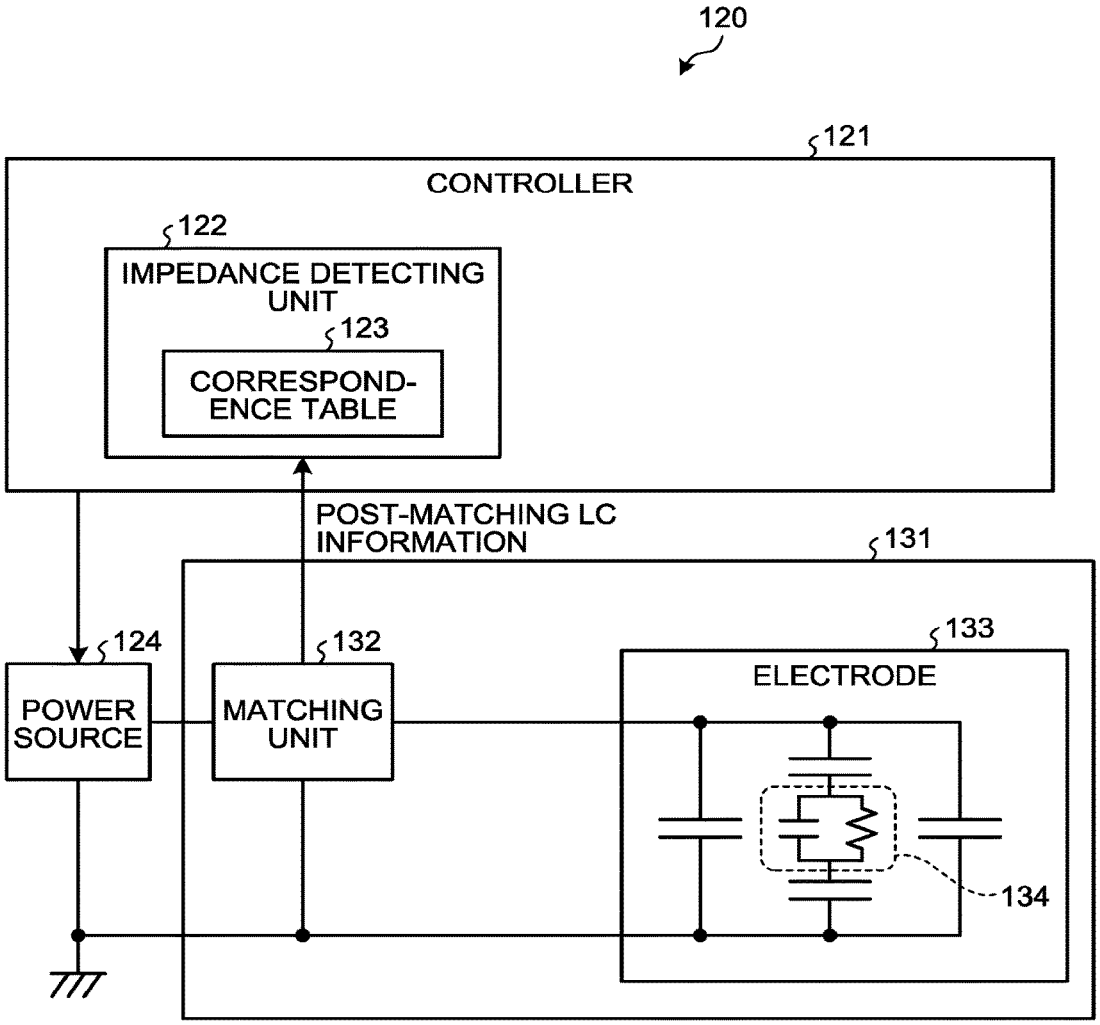
FIG. 3 is a block diagram illustrating an exemplary configuration of a dielectric heating unit.

Given below is the explanation of an exemplary configuration of the first dielectric heating unit 120. FIG. 3 is a block diagram illustrating an exemplary configuration of the first dielectric heating unit 120. As illustrated in FIG. 3, the first dielectric heating unit 120 includes a controller 121, a power source 124, and a drying unit 131. Moreover, the drying unit 131 further includes a matching unit 132 and an electrode 133. The second dielectric heating unit 320 can have identical functional blocks to those of the first dielectric heating unit 120. Meanwhile, the controller 121 can be included in the first dielectric heating unit 120 as well as in the second dielectric heating unit 320, or a single controller can be configured to control the first dielectric heating unit 120 and the second dielectric heating unit 320. In that case, a single controller either can be included in the first dielectric heating unit 120 or the second dielectric heating unit 320, or can be installed on the outside of the first dielectric heating unit 120 and the second dielectric heating unit 320.

The controller 121 functions as a control unit for controlling various operations of the first dielectric heating unit 120. For example, the controller 121 specifies an output value equivalent to the degree of drying, and instructs the drying unit 131 to perform drying. More particularly, the controller 121 outputs control signals to the power source 124 in such a way that a desired output value is achieved; and performs sleep/active control, frequency control, amplitude control, and phase control of the power source 124. The degree of drying for the drying unit 131 is varied according to the output value.

The power source 124 outputs a high-frequency voltage to the drying unit 131. The electrode 133 outputs, for example, a high-frequency voltage having the frequency, the amplitude, and the phase corresponding to the control performed by the controller 121.

The matching unit 132 performs impedance matching between the power source 124 and the electrode 133. For example, the matching unit 132 detects incident waves and reflected waves between the power source 124 and the electrode 133, and performs impedance matching.

The amount of ink (image) applied on a medium is not constant because, for example, the image pattern undergoes changes. Thus, regarding a medium on which an image is formed, the impedance changes when seen from the electrode 133. Moreover, when there is a decrease in the heating target such as water due to drying, there is a decrease in the target that absorbs the power. In that regard too, there is a change in the impedance. The matching unit 132 detects the incident waves and the reflected waves using a directional coupler, and outputs the detection result such as the amplitude and the phase difference to the controller 121. Then, according to the control signal output by the controller 121, the matching unit 132 adjusts the value of a variable capacitor and a variable inductor, which are included in the matching unit 132, in such a way that the reflected waves are set to zero and the impedance matches.

When a high-frequency electrical field is applied to a medium, the electrode 133 is used to heat and dry the ink present on the medium. Meanwhile, in FIG. 3, the electrode 133 is schematically illustrated as an equivalent circuit including an ink image portion 134, which is equivalent to the ink discharged onto the medium for the purpose of forming an image.

The controller 121 includes an impedance detecting unit 122 for detecting changes in the impedance. The controller 121 controls the power source 124 in such a way that drying control is performed according to the detection result of the impedance detecting unit 122. The controller 121 performs a drying operation in which, for example, the drying is stopped just before an increase in the conductivity of a portion onto which the ink has been discharged. In other words, the controller 121 performs a drying operation in which drying is stopped just before a decline in the impedance of the portion onto which the ink has been discharged.

The impedance detecting unit 122 detects the impedance of the ink image portion 134. The impedance detecting unit 122 obtains, for example, the post-matching value of the variable inductor and the variable inductor (LC information) from the matching unit 132. Then, the impedance detecting unit 122 refers to a correspondence table 123 and detects the impedance corresponding to the obtained value. For that reason, the correspondence table 123 is used to store variable capacitor values, variable inductor values, and impedance values in a corresponding manner. Herein, the correspondence table 123 can be stored in an external memory unit of the impedance detecting unit 122.

Figure 4:
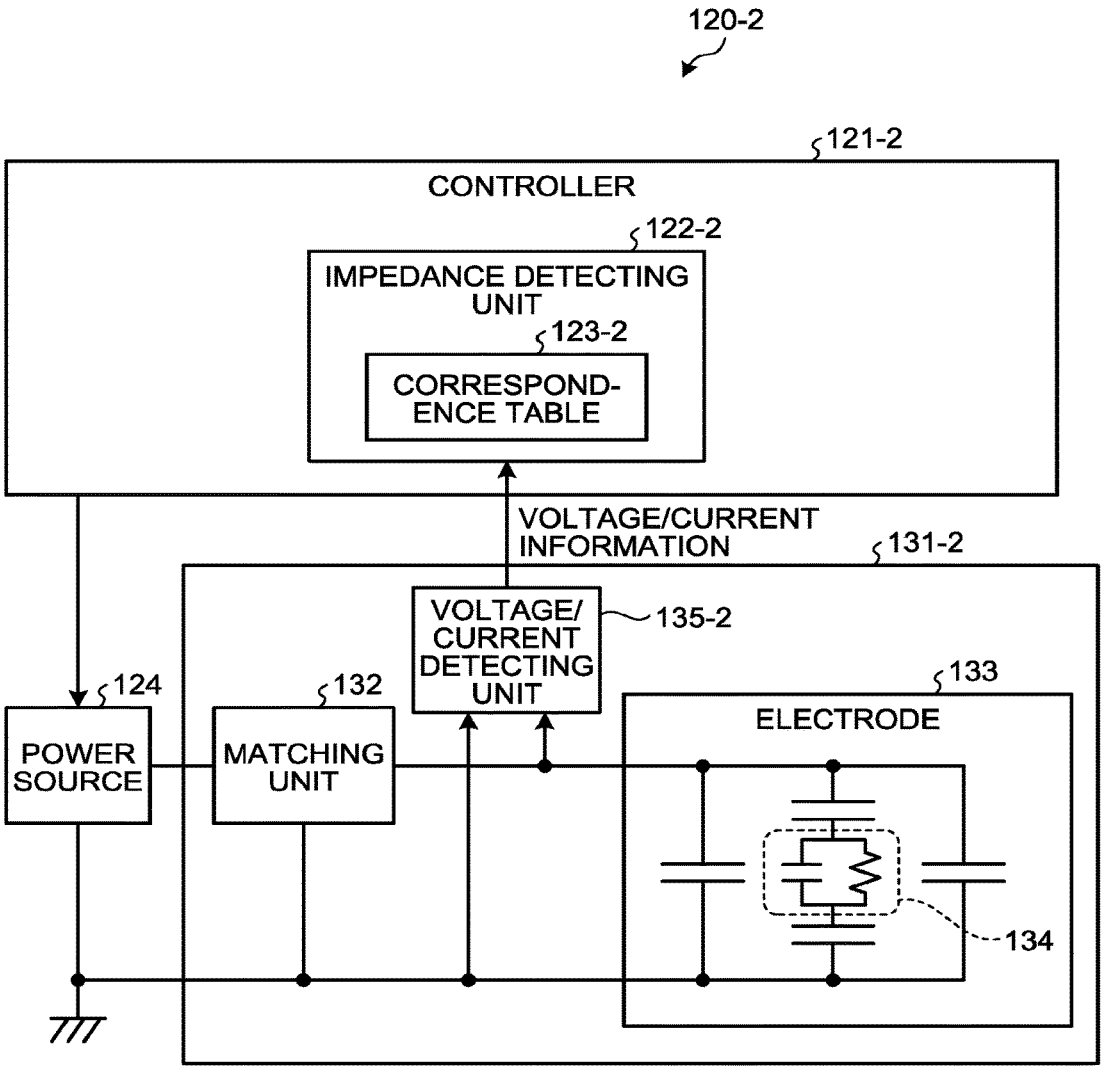
FIG. 4 is a block diagram illustrating an exemplary configuration of another dielectric heating unit.

Meanwhile, the impedance detecting unit 122 is not limited to have the configuration illustrated in FIG. 3. That is, as long as the impedance of the ink image portion 134 can be detected, the impedance detecting unit 122 can have any configuration. FIG. 4 is a block diagram illustrating an exemplary configuration of a first dielectric heating unit 120-2 that includes an impedance detecting unit 122-2 different than FIG. 3.

As illustrated in FIG. 4, the first dielectric heating unit 120-2 includes a controller 121-2, the power source 124, and a drying unit 131-2. Moreover, the controller 121-2 further includes the impedance detecting unit 122-2. Furthermore, the drying unit 131-2 further includes the matching unit 132, the electrode 133, and a voltage/current detecting unit 135-2. Herein, the functional units having identical functions to the functional units illustrated in FIG. 3 are referred to by the same reference numerals, and the explanation thereof is not repeated.

As compared to the drying unit 131 illustrated in FIG. 3, the drying unit 131-2 differs in the way of further including the voltage/current detecting unit 135-2. Herein, the voltage/current detecting unit 135-2 detects the voltage and the electrical current applied to the electrode 133.

The impedance detecting unit 122-2 obtains the detected voltage value and the detected current value (voltage/current information). Then, the impedance detecting unit 122-2 refers to a correspondence table 123-2 and detects the impedance corresponding to the obtained values. For that reason, the correspondence table 123-2 is used to store voltage values, current values, and impedance values in a corresponding manner. Herein, the correspondence table 123-2 can be stored in an external memory unit of the impedance detecting unit 122-2.

The correspondence table 123 illustrated in FIG. 3 and the correspondence table 123-2 illustrated in FIG. 4 are, for example, created in advance according to actual measurement values during an inspection process at the factory and are stored in the impedance detecting unit 122 and the impedance detecting unit 122-2, respectively.

Figure 5:
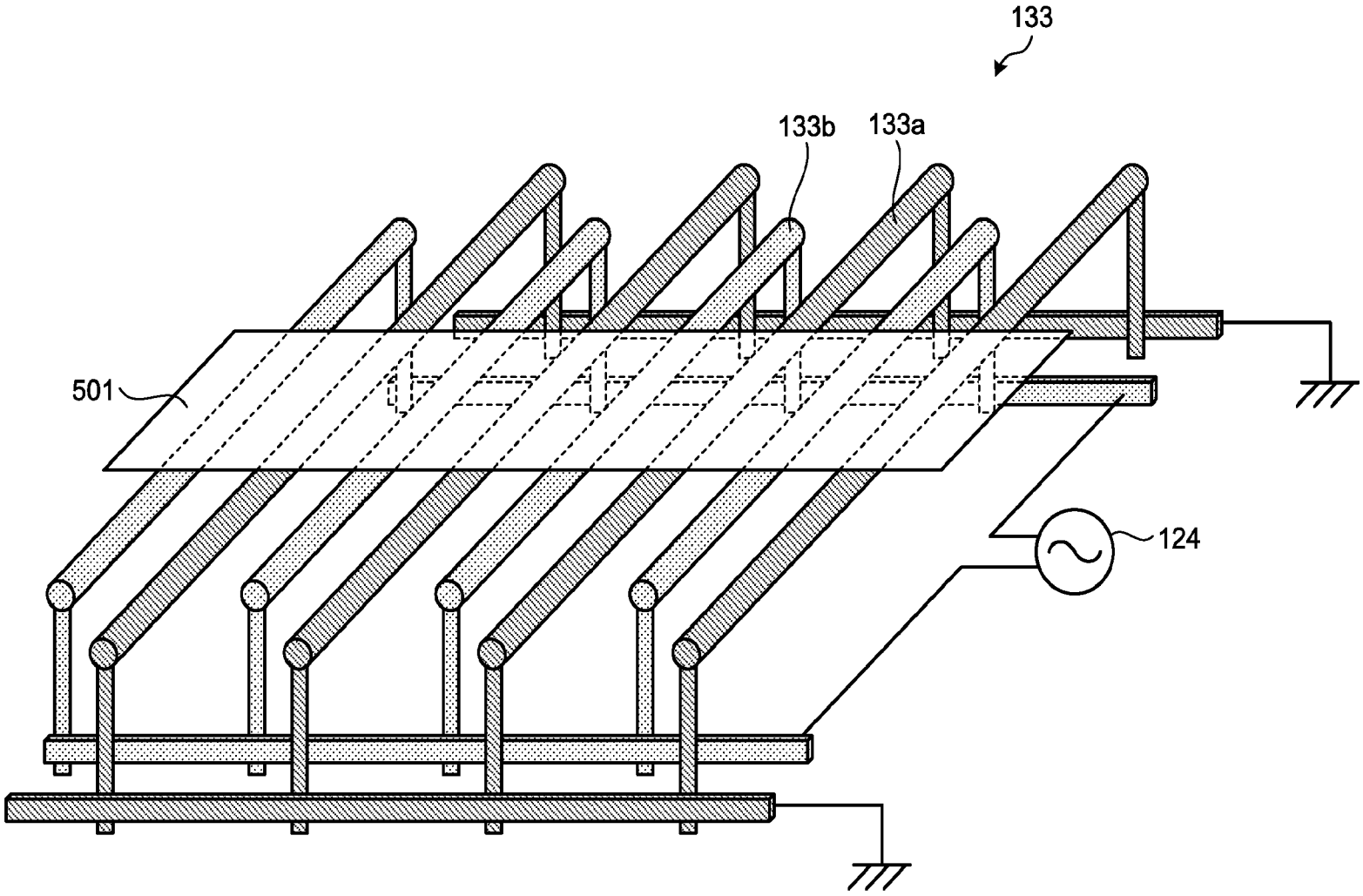
FIG. 5 is a schematic perspective view of an exemplary fundamental configuration of an electrode.

Explained below with reference to FIG. 5 is a configuration of the electrode 133. FIG. 5 is a schematic perspective view of an exemplary fundamental configuration of the electrode 133. Regarding the drying of the medium 501 representing a printed material, since it is necessary to have an opening through which the medium 501 would move in and out, it is often the case that a dielectric heating unit in which high-frequency waves in the bandwidth of 1 MHz to 100 MHz are used instead of microwaves from the perspective of radio wave leakage. Moreover, also from the perspective of heating unevenness, a dielectric heating unit in which high-frequency waves are used is advantageous. The microwaves are excellent at power density.

The electrode 133 includes rod electrodes **133*b* to which a high-frequency voltage is applied, and includes rod electrodes 133*a* as ground electrodes. There are a plurality of rod electrodes 133*a* and a plurality of rod electrodes 133*b* arranged in an alternate manner (such a configuration is called a grid electrode). To both ends of the rod electrodes 133*b*, the power source 124 is connected and a high-frequency voltage is applied. Both ends of the rod electrodes 133*a*** are connected to ground.

Figure 6:
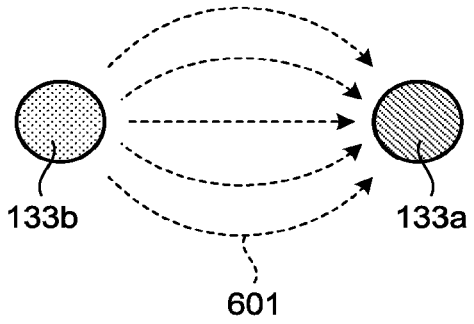
FIG. 6 is a schematic diagram illustrating the state of an electrical field formed between rod electrodes.
Figure 7:
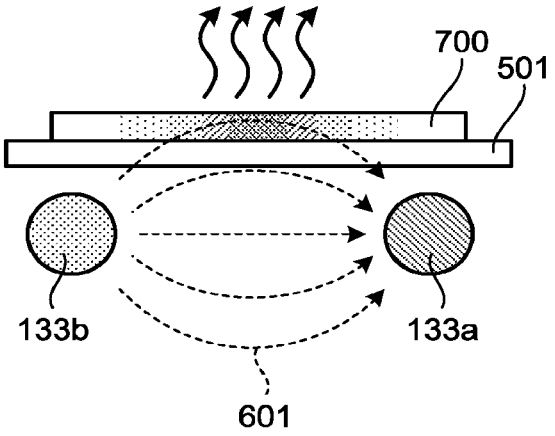
FIG. 7 is a schematic diagram illustrating a heat producing state of an ink image, which is formed on a medium, under the electric field formed between the rod electrodes.

As illustrated in FIG. 6, when a predetermined voltage is applied to the rod electrodes **133*b* from the power source 124, an electrical field 601 is formed between each pair of neighboring rod electrodes 133*b* and 133*a*. As illustrated in FIG. 7, when the medium 501, on which an ink image 700 is formed, is placed in the electrical field 601; primarily the ink image 700 formed on the medium 501 gets heated and produces heat. Meanwhile, with respect to the electrodes to which a high-frequency voltage is applied (the rod electrodes 133*b*); the ground electrodes (the rod electrodes 133*a*) can apply a high-frequency voltage having the phase reversed by 180°. Moreover, regarding the electrode composition, as long as an electrical field is generated, it does not matter if the electrode composition is not the grid electrode composition illustrated in FIG. 5**. In the case of drying a thin sheet-like object, since it is most effective to perform the drying alongside the grid electrodes, typically the grid electrodes are used.

Herein, closer the electrical field to the grid electrodes, the stronger becomes the electrical field strength. Hence, it is desirable that the medium 501 is heated and dried by moving it as close to the electrodes as possible. The strength of the electrical field 601 is the strongest in the intermediate portion between each pair of neighboring rod electrodes 133*b* and 133*a* (uniform heating), and the electrical field becomes smaller in the portion right above the rod electrodes 133*b* and 133*a*. Accordingly, on the medium 501 that is stationary, heating unevenness occurs (for example, between an intermediate portion 801 of the rod electrodes 133*b* and 133*a* and an overhead portion 802 of the rod electrode 133*b*) as illustrated in FIG. 8.

Figure 8:
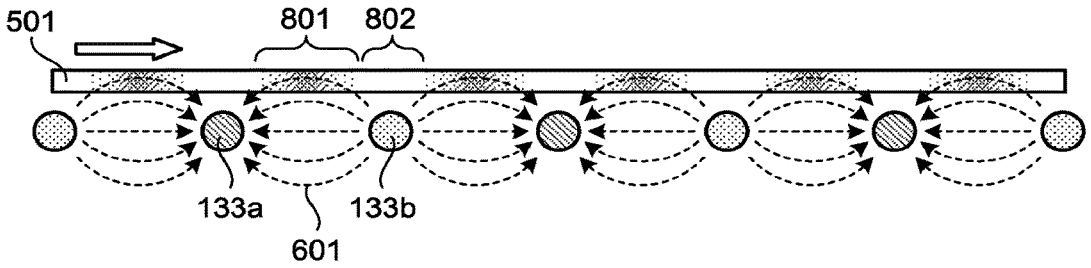
FIG. 8 is a schematic diagram illustrating heating distribution in a grid electrode.

However, as illustrated in FIG. 8, if the medium 501 moves at a constant speed along the grid electrode in the direction of an arrow, heating unevenness does not occur as far as the entire medium 501 is concerned. If the rod electrodes 133*a* and 133*b* are placed in an equidistant manner, then it becomes possible to even out the electrical field strength between each pair of rod electrodes 133*a* and 133*b*. Consequently, it becomes possible to provide such a grid electrode in which heating unevenness does not occur in entirety.

Given below is the example of the relationship of the dry state of the ink with the conductivity. The following explanation is mainly given for the example of a black ink containing carbon black particles. The ink used in an inkjet printer contains various substances by taking into account the viscosity, the drying characteristic, and the preservation stability. The major components include water, a solvent, and a coloring matter. The coloring matter can be a dye or a pigment. When the medium is not a dedicated medium such as coated paper, a pigment is advantageous in the chromogenic property. In the case of a black ink, the carbon black has the highest black concentration and is commonly used as the black pigment. However, the carbon black is electrically conductive in nature; and the contact among the carbon black particles after the drying of the ink results in conductivity. If the first dielectric heating unit 120 performs heating in such an electrically conductive state, it results in anomalous heating thereby causing sparking.

Figure 9:
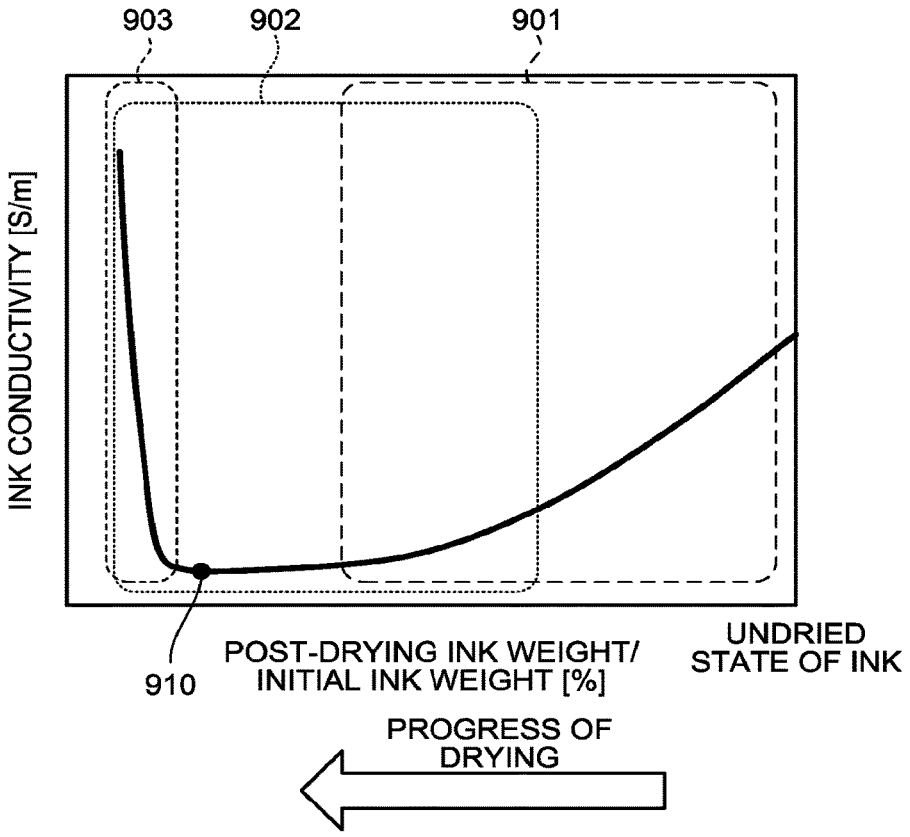
FIG. 9 is a diagram illustrating variation in the drying and the conductivity of a black ink having the commonplace carbon black.

FIG. 9 is a diagram illustrating variation in the drying and the conductivity of a black ink having the commonplace carbon black. The horizontal axis represents the percentage (%) of the weight of the post-drying ink with respect to the weight of the undried ink (i.e., the initial ink weight). The vertical axis represents the conductivity (S/m) of the ink.

Typically, a solvent has a higher boiling point than water. Hence, the progress in the drying initially leads to the evaporation of water, and that is followed by the drying of the solvent, which marks the completion of the drying. In FIG. 9, phases 901, 902, and 903 represent respectively a water drying phase, a solvent drying phase, and a conductivity increasing phase. A dry state 910 represents the dry state just before an increase in the conductivity, and represents the target dry state that is to be achieved at the time of drying the first face.

Figure 10:
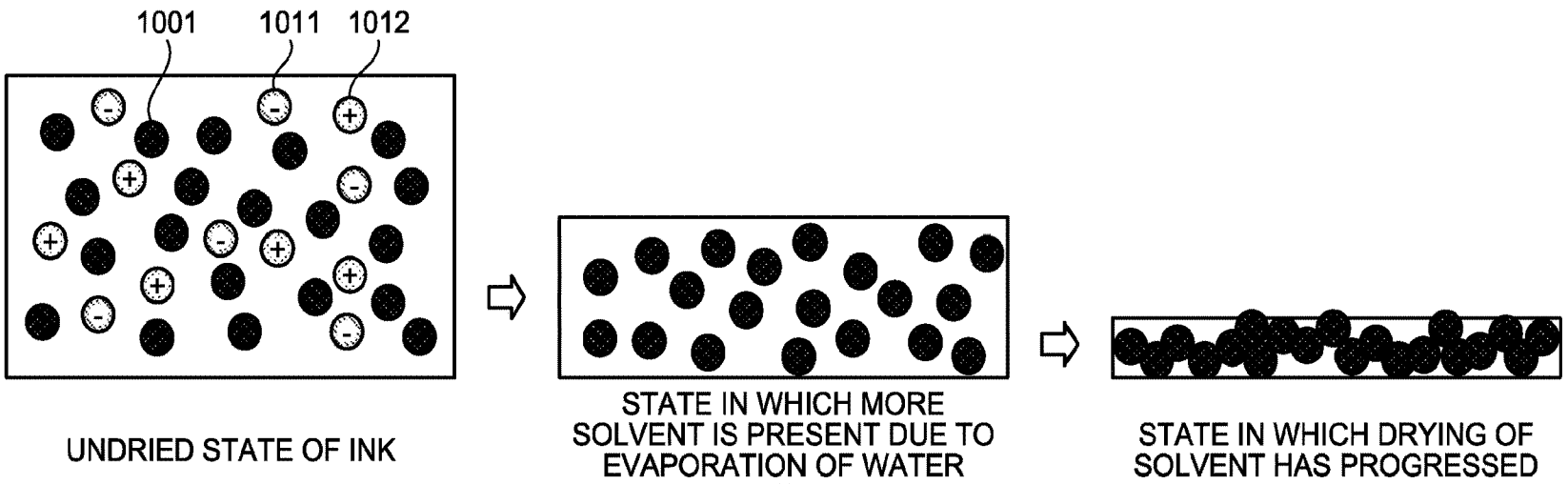
FIG. 10 is a schematic diagram illustrating an example of the variation in the conductivity at the time of drying a black ink.

FIG. 10 is a schematic diagram illustrating an example of the variation in the conductivity at the time of drying a black ink. In the state in which the ink is not dried as illustrated on the left-hand side in FIG. 10, carbon black particles 1001 are surrounded by a sufficient amount of water, and ions (negative ions 1011 and positive ions 1012) are also present. Hence, the conductivity is relatively higher. As illustrated in the middle portion in FIG. 10, as the water dries up, the ions go on decreasing and the conductivity falls down. In the case in which only a solvent and the carbon black are present, the conductivity falls down to lowest level. As illustrated on the right-hand side in FIG. 10, when there is some progress in the drying of the solvent, the carbon black particles make contact with each other and it leads to a surge in the conductivity.

As given below in Equation (1), higher the conductivity, the easier it is for the ink to get heated.

$$P = 1/2 \times \sigma \times |E|^2 + \pi \times f \times \varepsilon 0 \times \varepsilon r'' \times |E|^2 \quad (1)$$
$$= (1/2 \times \sigma + \pi \times f \times \varepsilon 0 \times \varepsilon r'') \times |E|^2$$

Herein,

P: calorific value; [W/m$^3$]

σ: conductivity; [S/m]

E: electrical field strength; [V/m]

F: frequency; [Hz]

∈0: electric permittivity of vacuum; 8.854E−12; [F/m]

∈r": imaginary part of complex relative permittivity of object; [no unit]; (=∈r'·tan δ)

Typically, inks are weakly ionizable. Still, most inks have the conductivity of 0.01 S/m or more. Hence, regarding an ink, as compared to water (∈'=80, tan δ=0.03) representing the dielectric substance, the member of conductivity becomes dominant.

When a lot of water is included, it is easier for the ink to get heated. However, the heating is used for the heat of vaporization of the water and the solvent, and the temperature also does not go beyond about 100° C. When there is an increase in the conductivity due to the contact among the post-drying carbon black particles, not only a large amount of heat is produced, but the heat capacity is also small as well as there is no more restriction on the rise of temperature attributed to boiling. Hence, heating occurs at a rapid pace thereby causing ignition or sparking.

In that regard, in the first embodiment, it is desirable to have a configuration in which the drying of the first face is stopped just before an increase in the conductivity. Given below is the explanation of the reason for which such a configuration is desirable. In this state, since the solvent is also included, the drying is incomplete as such. Thus, if the transfer of ink in the subsequent inverting unit 200 looks set to occur, then it is desirable to use an air discharging roller.

Figure 11:
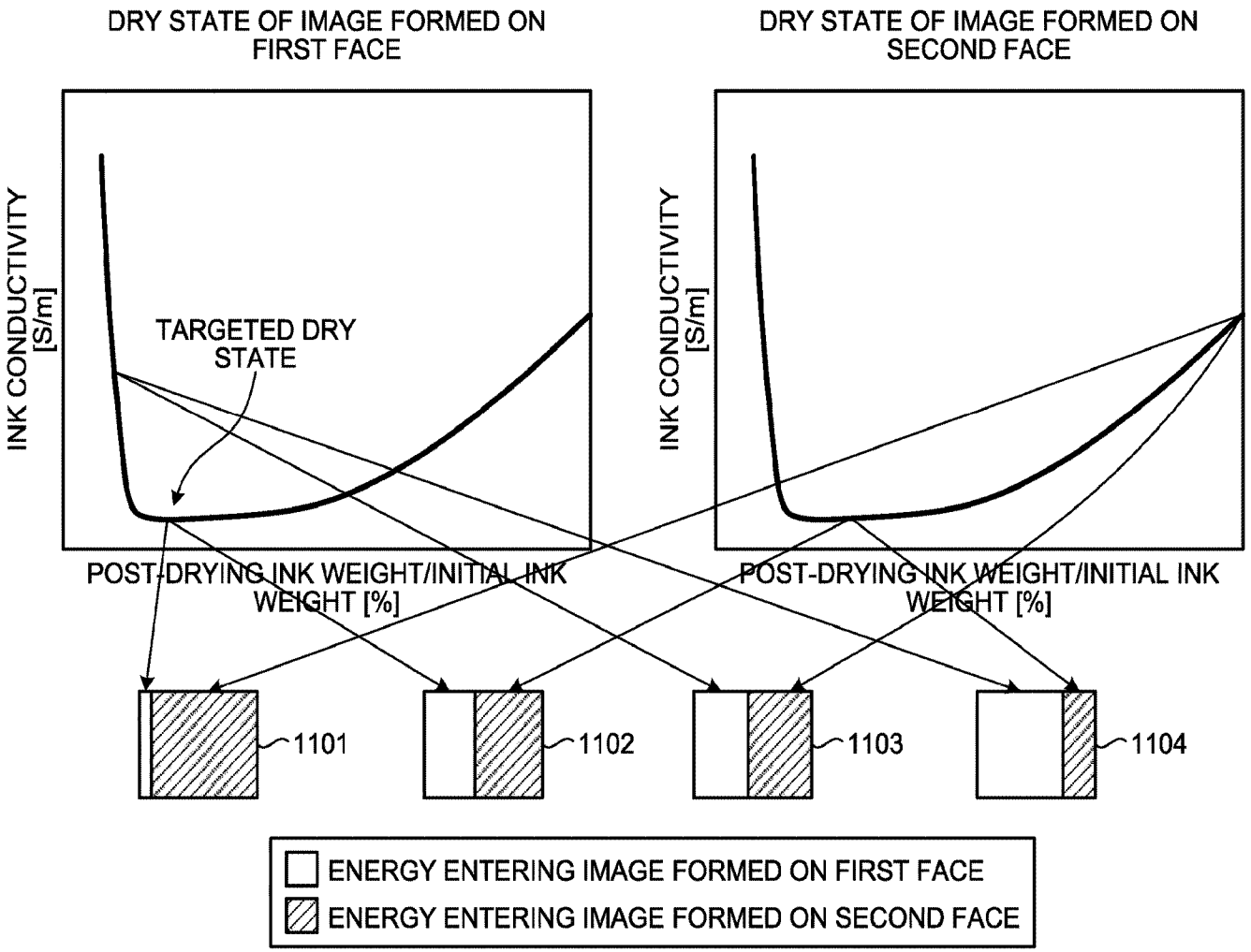
FIG. 11 is a diagram illustrating an example of the relationship between the energies input at the time of drying a second face.

FIG. 11 is a diagram illustrating an example of the relationship between the energies input onto the faces (the first face and the second face) at the time of drying the second face. Herein, energy states 1101 to 1104 represent the energy states corresponding to the four combinations of the dry state of the first face and the dry state of the second face. In the energy states, the left-hand rectangles correspond to the energy input onto the first face; and the right-hand rectangles (hatched portions) correspond to the energy input onto the second face. The width of each rectangle represents the magnitude of energy.

Immediately prior to the drying of the second face, the image formed on the second face contains a lot of water. Thus, the second face side has a high conductivity while the first face side has a low conductivity. For that reason, the drying energy gets concentrated on the second face side, and the drying is performed in an effective manner. The energy states 1101 and 1102 represent the energy states at that time.

However, if the first face is excessively dried thereby resulting in an increase in the conductivity of the image formed on the first face, a lot of drying energy gets applied onto the first face side too. The energy states 1103 and 1104 represent the energy states at that time.

The fact that such energy states are attained can be explained from the fact that the first face and the second face can be replaced by an equivalent circuit having parallel resistance. For example, in the state in which the conductivity of the image formed on the first face has increased, assume that energy is applied onto the first face. In that case, since already there is no water and since the heat capacity is small as described earlier, heating occurs at a rapid pace thereby easily resulting in ignition or sparking.

In the state in which there is progress in the drying of the image formed on the second face thereby leading to a decrease in the conductivity, it becomes difficult for the energy to enter the second face side. At that time, if the conductivity of the image formed on the first face has stayed low, then the energy gets evenly input onto the image formed on the first face and the image formed on the second face, and there is no rapid heating of the image formed on the first face. However, if the conductivity of the image formed on the first face has increased even if only slightly, then there is a risk that the energy gets concentrated on the first face thereby easily resulting in ignition or sparking.

For such reasons, during the drying of the first face, it is suitable if the conductivity does not increase and the solvent is as less as possible. The dry state 910 illustrated in FIG. 9 is an example of the ideal state.

Figure 12:
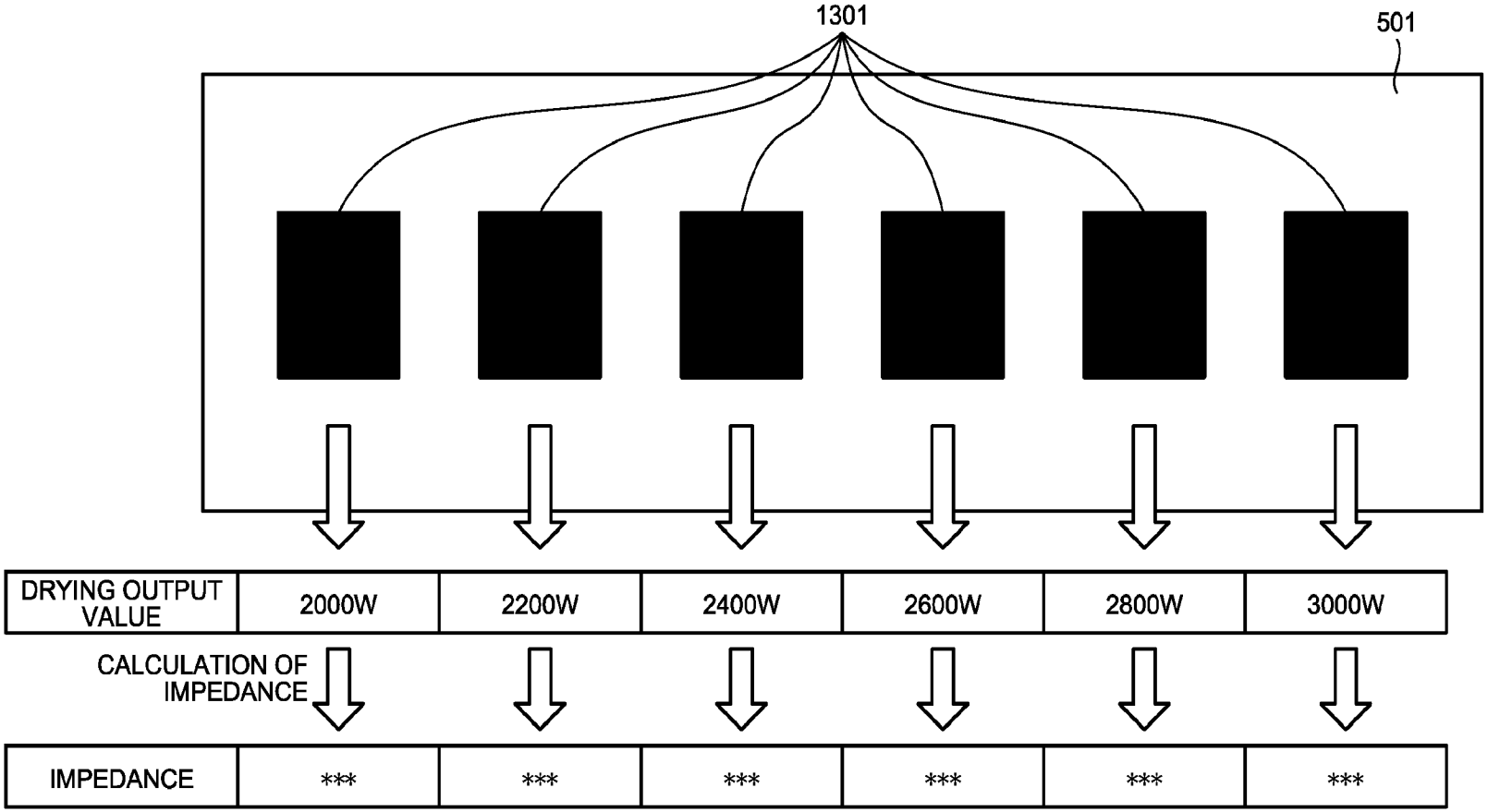
FIG. 12 is a diagram for explaining an example of an initial adjustment operation.

In FIG. 12 is illustrated an example in which six allover pattern images 1301 are formed on the medium 501 and are dried using drying output values of 2000 W, 2200 W, 2400 W, 2600 W, 2800 W, and 3000 W, respectively. Based on such information, the impedance of the image with respect to each drying output value (i.e., the image impedance) can be obtained.

Figure 13:
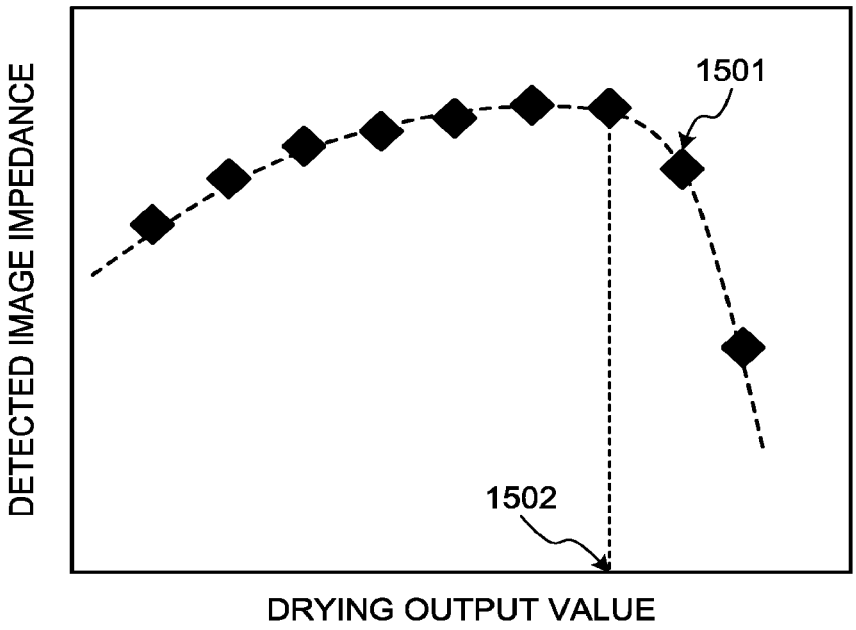
FIG. 13 is a diagram illustrating an example of the relationship between drying output values and image impedances.

FIG. 13 is a diagram illustrating an example of the relationship between the drying output values and the image impedances. Herein, higher the drying output value, the higher is the extent of evaporation of the water and the solvent and the more is the progress in drying. Since the impedance and the conductivity are in the relationship of being reciprocals, the graph illustrated in FIG. 13 becomes a reversed graph of the graph illustrated in FIG. 9.

In FIG. 13, a drying output value 1502, which is lower by one step than the drying output value corresponding to rapidly-declining image impedance 1501, is equivalent to, for example, the optimum dry state 910 illustrated in FIG. 9. Thus, the controller 121 extracts that drying output value. As described earlier, the optimum drying output value varies according to the image pattern. For that reason, according to the image information of the target for drying, correction can be performed with respect to the drying output value obtained during the initial adjustment.

Meanwhile, regarding the drying output condition for the second face, as long as there is no anomalous heating or sparking of the black ink on the first face as well as the second face, it does not matter if the conductivity rises in some degree. Moreover, there is no particular restriction on the extraction method regarding that condition.

Herein, what needs to be taken into account is the case in which the second face is an image just about white. In the state in which there are many solvent components and the conductivity is low, the image formed on the first face does not get heated rapidly. However, if there is no image formed on the second face, then the heating energy that is attributed to the high-frequency electrical field applied from the second face side gets concentrated on the image formed on the first face. Hence, the image formed on the first face gets rapidly heated thereby leading to a risk of ignition or sparking.

Figure 14:
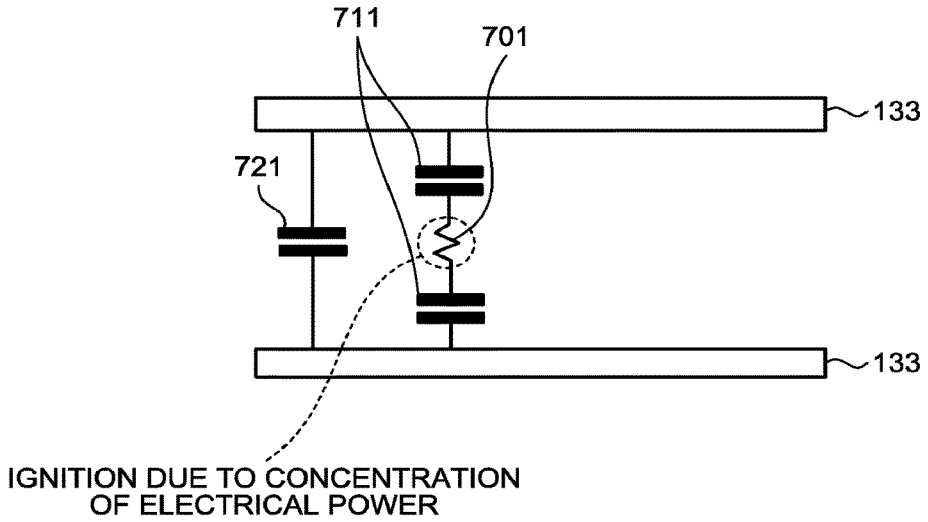
FIG. 14 is a diagram illustrating an exemplary equivalent circuit in the case in which no image is formed on the second face.

If such a state is represented using an equivalent circuit, then a circuit illustrated in FIG. 14 is achieved. A resistance 701 represents the resistance of the image formed on the first face. Moreover, capacitances 711 represent the electrostatic capacitances between the electrodes 133 and the image formed on the first face. Furthermore, a capacitance 721 represents the electrostatic capacitance between the electrodes 133. When no image (an image just about white) is formed on the second face, the electrical power (the heating energy) gets concentrated at the resistance 701. As a result, if there is excessive evaporation of the solvent and if there is an increase in the conductivity of the image formed on the first face, then there occurs drastic heating (thermal runaway) of the image formed on the first face. Under such a condition, the upper limit of the drying output values on the second face needs to be lower than the drying output value at which thermal runaway occurs on the image formed on the first image. If the image formed on the second face cannot be sufficiently dried using a drying output value satisfying the condition given above, it implies that there is no solution of drying output values on the second face.

Figure 15:
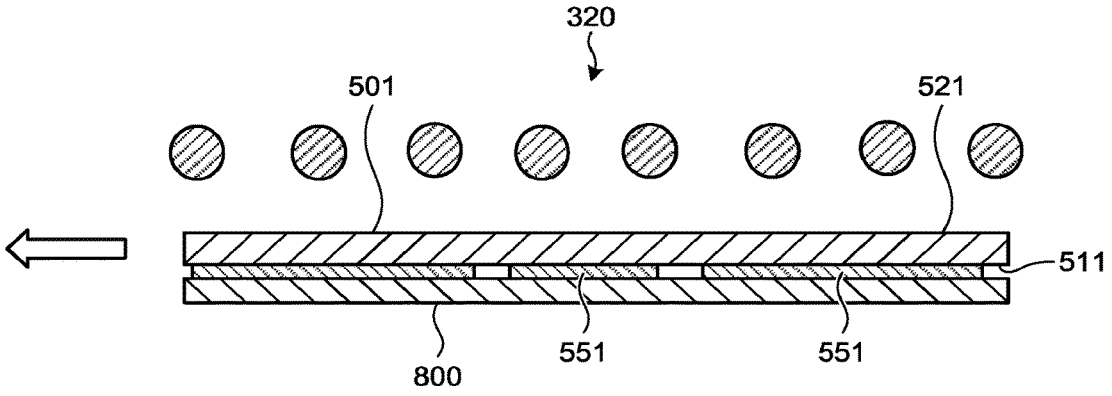
FIG. 15 is a diagram illustrating an exemplary configuration of a drying device of a second image forming unit according to the first embodiment, and illustrating a configuration in the case in which no image is formed on the second face.

In FIG. 15 is illustrated an exemplary structure for solving such an issue. In FIG. 15 is illustrated a structure of a drying device in the second image forming unit 300. In FIG. 15, a structure is illustrated in which a conductive member 800 is disposed close to the second dielectric heating unit 320.

The conductive member 800 is a sheet-like member having a uniform thickness. Since the conductive member 800 affects the electrical field, if the conductive member 800 has different thicknesses at different positions, there occurs distribution of the electric field thereby causing drying unevenness. Hence, it is desirable that the conductive member 800 has a uniform thickness all over.

In this example, the conductive member 800 is so fixed that it abuts against the medium 501 (i.e., against an image 551 formed on a first face 511) to which a high-frequency electrical field has been applied from the second dielectric heating unit 320. However, the conductive member 800 need not always be abutting against the first face 511. That is, within the range in which the function effects (relaxation in the concentration of the electrical power (described later) and the use of exhaust heat (described later)) identical to the case of abutment can be achieved; the conductive member 800 can be disposed at a position close to the medium 501.

Figure 16:
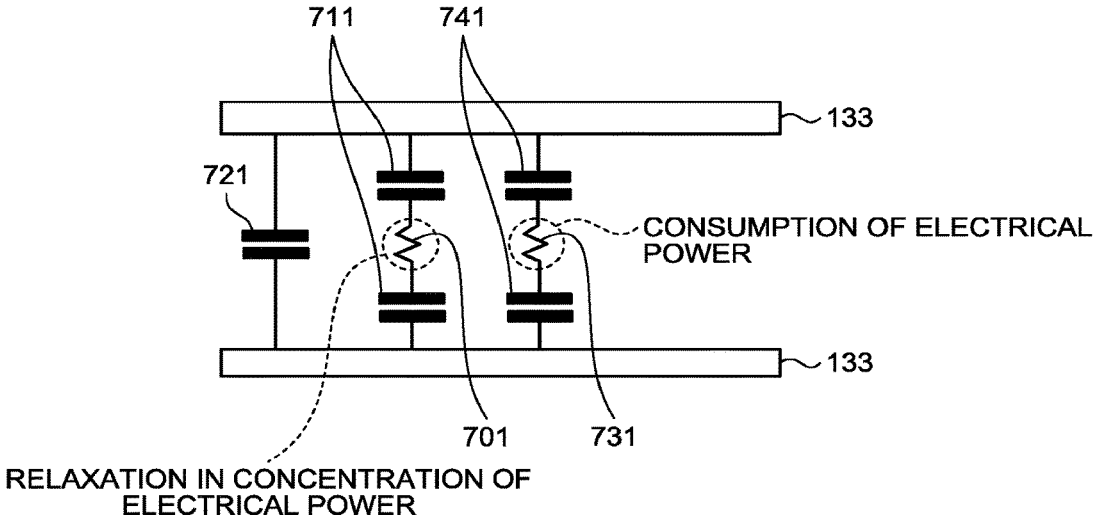
FIG. 16 is a diagram illustrating an exemplary equivalent circuit corresponding to the configuration illustrated in FIG. 15.

An equivalent circuit for that case is illustrated in FIG. 16. A resistance 731 represents the resistance of the conductive member 800. Moreover, capacitances 741 represent the electrostatic capacitances of the conductive member 800. As a result of disposing the conductive member 800, the resistance 701 of the image 551 formed on the first face 511 gets lined in parallel with the resistance 731 of the conductive member 800. Consequently, the electrical power is consumed in the resistance 731 of the conductive member 800, and it leads to relaxation in the concentration of the electrical power at the resistance 701 of the image 551 formed on the first face 511. Herein, smaller the resistance 731 of the conductive member 800, the greater is the extent of holding down the heating energy entering the image 551 formed on the first face 511. That enables avoiding thermal runaway of the image 551 formed on the first face 511.

In the state in which the medium 501 and the conductive member 800 are in contact with each other, the capacitances 711, 721, and 741 between the load in FIG. 16 and the electrodes 133 become substantially equal. Hence, the discussion can be focused only on the load. Regarding the load, the reciprocal of the resistance (i.e., the conductance) can be expressed as (conductivity)×(thickness)×(width)/(inter-electrode distance). Herein, regarding the image 551 formed on the first face 511 and the conductive member 800, when the distance between two electrodes 133 is substantially equal to the width of the electrodes 133; if the relationship given below in Equation (2) is satisfied, then a greater amount of heating energy enters the conductive member 800. In Equation (2), "first drying" represents the drying performed by the first dielectric heating unit 120.

(the conductivity of the image formed on the first face after first drying thereof)×(the thickness of the image formed on the first face after first drying thereof)<(the conductivity of the conductive member)×(the thickness of the conductive member) (2)

Thus, it is desirable that the conductive member 800 has the conductivity equal to or greater than a certain level. With reference to FIG. 9, in the dry state in which the ink conductivity is at the lowest level, the ink conductivity is in the order of 0.001 S/m to 0.01 S/m. Usually, a dry ink has the thickness at the level of 5 μm or less. Hence, for example, when the conductive member 800 has the thickness of about 1 mm, it is desirable that the conductivity of the conductive member 800 is at least $1\times10^{-5}$ S/m or more.

In order to achieve the conductive member 800 having the conductivity controlled within the range described above; for example, it is possible to implement nanotechnology. For example, an insulating material such as resin or ceramic can be subjected to nanotechnology so as to disperse a conductive filler in the insulating material, and the conductive member 800 having the desired conductive property can be manufactured. Moreover, the conductivity can be controlled using the material of the base, the material of the filler, the size/shape of the filler, and the density of the filler. In the first embodiment, since the conductive member 800 produces heat due to the heating energy, it is desirable that a base having heat resistance is used in the conductive member 800. For example, it is desirable that conductive ceramic is used. Examples of conductive ceramic include alumina 96. The filler can be particles such as carbon nanoparticles, copper nanoparticles, or silver nanoparticles; or can be a structure such as a nanowire or a nanotube.

Figure 17:
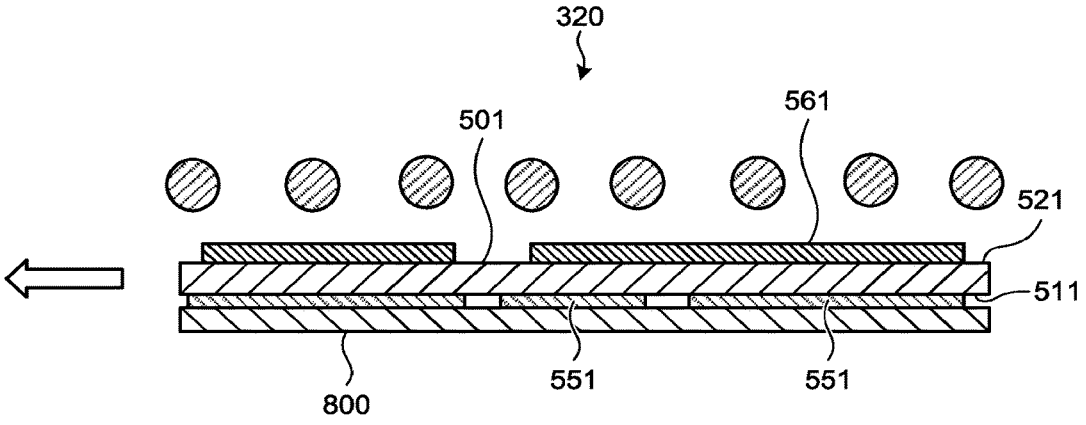
FIG. 17 is a diagram illustrating an exemplary configuration of a drying device of the second image forming unit according to the first embodiment, and illustrating a configuration in the case in which an image has been formed on the second face.
Figure 18:
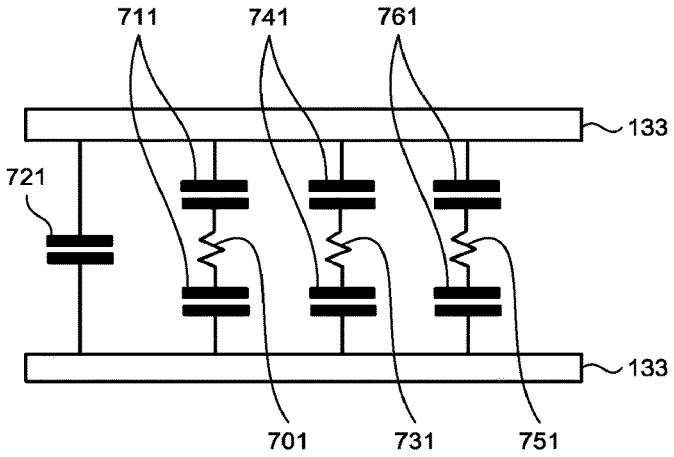
FIG. 18 is a diagram illustrating an exemplary equivalent circuit corresponding to the configuration illustrated in FIG. 17.

As described earlier, higher the conductivity of the conductive member 800, the more difficult it is for the heating energy to enter the image 551 formed on the first face 511 and the more it is in favor of holding down thermal runaway. However, as illustrated in FIG. 17, when an image 561 is formed on a second face 521; it becomes necessary to sufficiently heat the image 561, which is formed on the second face 521, while holding down thermal runaway of the image 551 formed on the first face 511. In FIG. 18 is illustrated an equivalent circuit for that case. A resistance 751 represents the resistance of the image 561 formed on the second face 521. Moreover, capacitances 761 represent the electrostatic capacitances of the image 561 formed on the second face 521. As a result of the formation of the image 561 formed on the second face 521, the resistance 701 of the image 551 formed on the first face 511, the resistance 731 of the conductive member 800, and the resistance 751 of the image 561 formed on the second face 521 get lined in parallel.

At that time, it is desirable to ensure that the heating energy is withheld from entering upon the image 551 formed on the first face 511, and to ensure that the heating energy of a necessary and sufficient amount enters upon the image 561 formed on the second face 521. For that reason, it is desirable that the conductive member 800 has a smaller conductance than the conductance of the image 561 formed on the second face 521, and it is desirable that the relationship given below in Equation (3) is satisfied. In Equation (3), "the image formed on the undried second face" represents the image 561 formed on the second face 521 and is not yet heated by the second dielectric heating unit 320.

(the conductivity of the conductive member)×(the thickness of the conductive member)<(the conductivity of the image formed on the undried second face)×(the thickness of the image formed on the undried second face) (3)

According to Equations (2) and (3) given above, it is desirable that the conductivity of the conductive member 800 satisfies the relationship given below in Equation (4).

(the conductivity of the image formed on the first face after first drying thereof)×(the thickness of the image formed on the first face after first drying thereof)<(the conductivity of the conductive member)×(the thickness of the conductive member)<(the conductivity of the image formed on the undried second face)×(the thickness of the image formed on the undried second face) (4)

As illustrated in FIG. 9, the image 561 formed on the undried second face 521 has a higher conductivity (the ink conductivity in the water drying phase) than the conductivity of the image 551 formed on the first face containing many solvent components (the ink conductivity in the solvent drying phase). Thus, there exists a suitable range of the conductivity of the conductive member 800. Oftentimes, an ink in the undried state has the conductivity close to 0.1 S/m. Hence, during the drying of the image 551 formed on the first face 511, it is important to hold down the conductivity of the image 551 to a level not particularly high.

Figure 19:
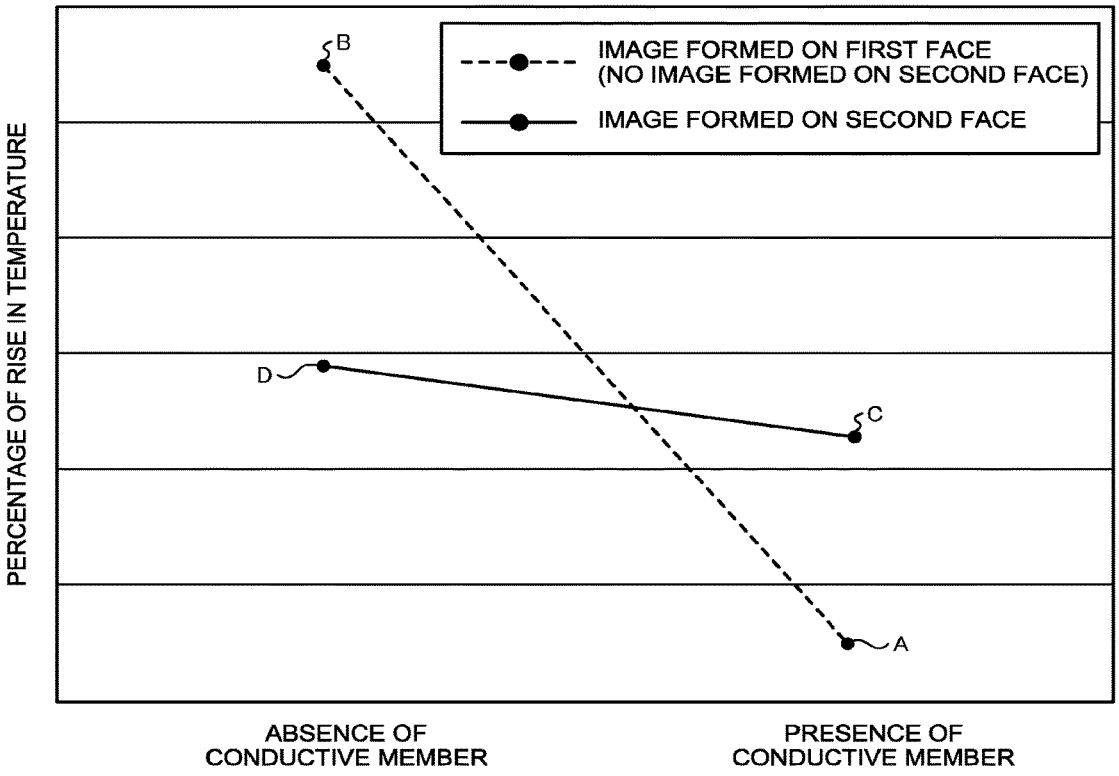
FIG. 19 is a diagram illustrating an example of a simulation result of comparing a case in which a conductive member is disposed and a case in which the conductive member is not disposed.

In FIG. 19 is illustrated a simulation result of comparing the percentage of rise in temperature of the ink in the case in which the conductive member 800 is disposed and the percentage of rise in temperature of the ink in the case in which the conductive member 800 is not disposed. In the case in which the image 561 has not been formed on the second face 521 and the conductive member 800 is disposed, a percentage A of rise in temperature of the image 551 formed on the first face 511 is considerably lower than a percentage B of rise in temperature of the image 551 formed on the first face 511 in the case in which the image 561 has not been formed on the second face 521 and the conductive member 800 is not disposed. Moreover, in the case in which the conductive member 800 is disposed, a percentage C of rise in temperature of the image 561 formed on the second face 521 is somewhat lower than a percentage D of rise in temperature of the image 561 formed on the second face 521 in the case in which the conductive member 800 is not disposed. Since the difference between the percentages C and D is smaller than the difference between the percentages A and B, it can be said that disposing the conductive member 800 enables sufficient drying of the image 561, which is formed on the second face 521, while reliably curbing thermal runaway of the image 551 formed on the first face 511.

Moreover, as described earlier, since the conductive member 800 has the function of letting out the heating energy that has concentrated on the image 551 formed on the first face 511, exhaust heat is generated. If the exhaust heat is effectively used in drying the images 551 and 561, then it becomes possible to achieve overall energy conservation. In the first embodiment, as illustrated in FIGS. 15 and 17, the conductive member 800 is disposed to abut against the medium 501. As a result of such a structure, there is excellent transfer of the exhaust heat from the conductive member 800 to the medium 501, and the exhaust heat is effectively used in drying the images 551 and 561. Meanwhile, even if the conductive member 800 and the medium 501 are not in contact with each other, as long as they are disposed close enough to each other so as to enable the transfer of exhaust heat, an effect of the same quality can be achieved.

Figure 20:
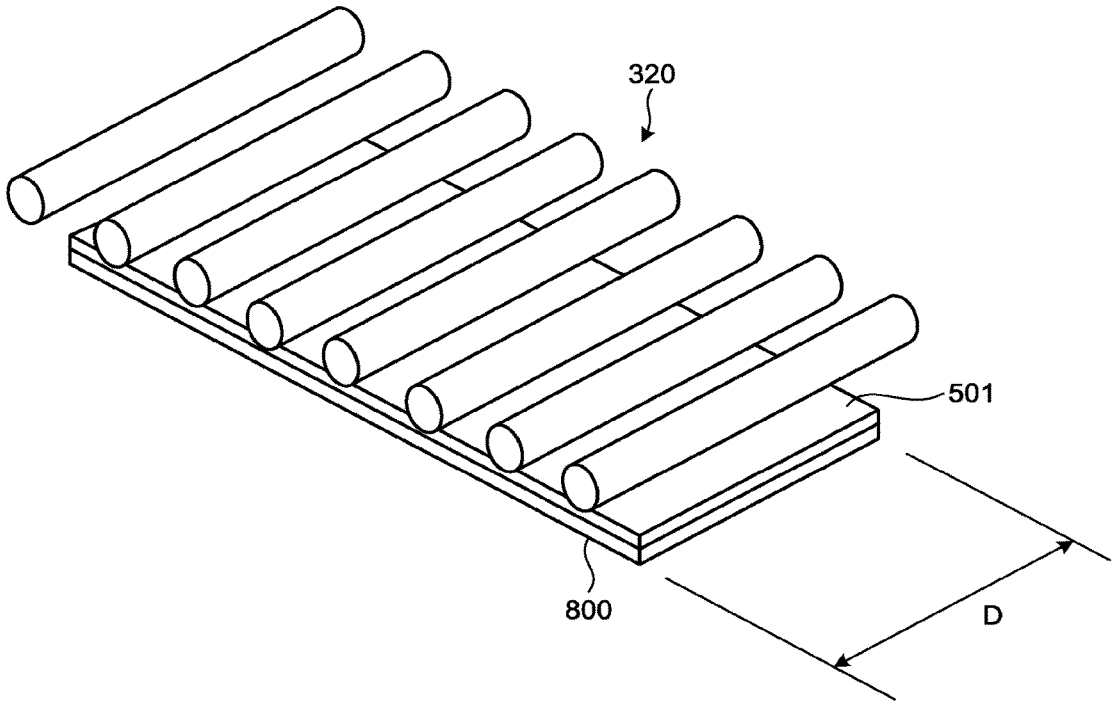
FIG. 20 is a diagram illustrating an example of a preferred shape of the conductive member.

In order to further enhance the effect of using the exhaust heat, it is desirable that, as illustrated in FIG. 20, the width of the conductive member 800 is set to be substantially equal to a width D of the medium 501 from the perspective of preventing drying unevenness.

In an undried ink, the conductive property is evident due to the ions in the ink. Since the ionic activity becomes more vigorous as the temperature becomes higher, the conductivity increases accompanying a rise in temperature. Thus, because the image 561 of the second face 521 is heated using the conductive member 800, the image 561 has an increased conductivity and becomes easily dryable by dielectric heating.

As described above, in the drying device according to the first embodiment, even if a liquid containing a conductive material is used, drying can be performed without causing anomalous heating or sparking.

Given below is the explanation of other embodiments with reference to the accompanying drawings. However, the constituent elements having an identical or corresponding function effect are referred to by the same reference numerals and the explanation thereof is not repeated.

Second Embodiment

Figure 21:
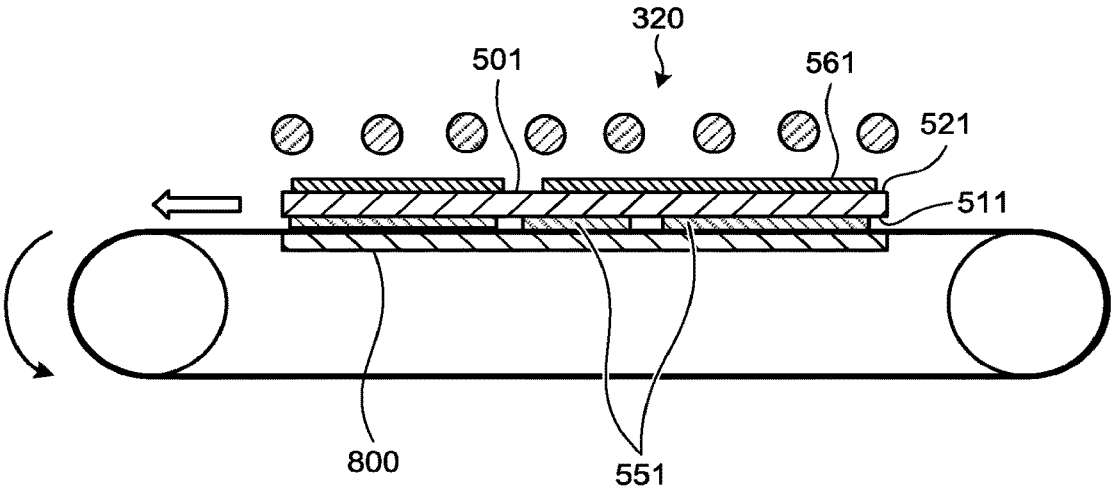
FIG. 21 is a diagram illustrating an exemplary configuration of a drying device of a second image forming unit according to a second embodiment.

In the configuration illustrated in FIG. 15 or FIG. 17, since the image 551, which is formed on the first face 511 that is moving, comes in contact with the conductive member 800 that is fixed; sometimes there is a concern about the damage caused to the image 551 due to friction. In such a case, as illustrated in FIG. 21, in between the medium 501 and the conductive member 800, a belt member 850 can be disposed that moves while making contact with the medium 501. That enables achieving prevention of the friction of the image 551.

Third Embodiment

Figure 22:
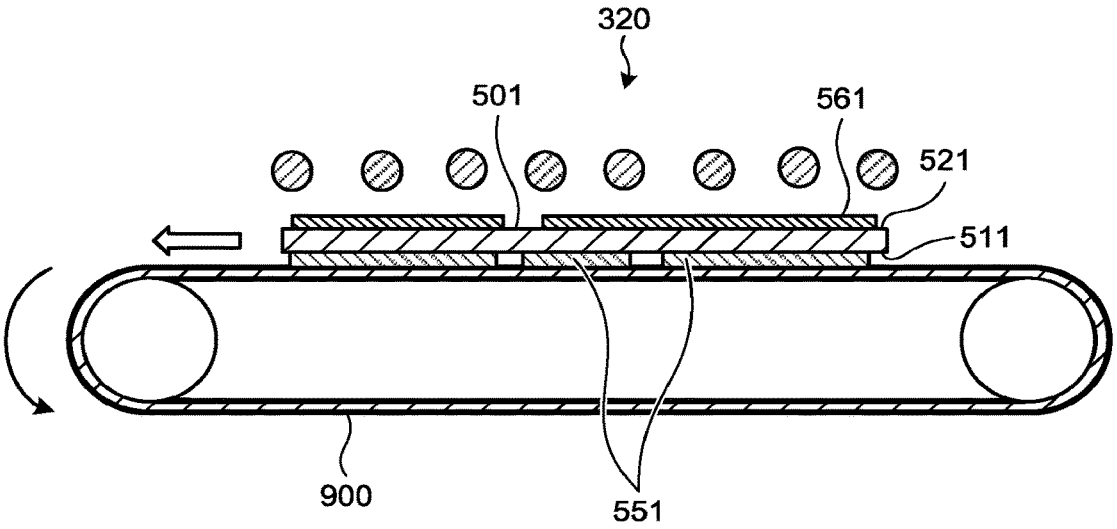
FIG. 22 is a diagram illustrating an exemplary configuration of a drying device of a third image forming unit according to the second embodiment.

As illustrated in FIG. 22, it also possible to use a conductive member 900 that moves along with the medium 501. In FIG. 22 is illustrated the conductive member 900 that is of belt type. However, the shape of the conductive member 900 is not limited to this example. Alternatively, for example, the sheet-like conductive member 800 illustrated in FIGS. 15 and 17 can be configured to move along with the medium 501. Since the belt-type conductive member 900 requires being soft in nature, it is difficult to use normal ceramic as the base. Alternatively, for example, it is possible to use a belt member in which aramid fiber or glass fiber is combined with a nanowire. As a result of using such a belt member, it becomes possible to manufacture the conductive member 900 having sufficient durability and sufficient heat resistance. With that, not only the friction of the image 551 can be prevented, but the effects such as the relaxation in the concentration of the electrical power and the use of exhaust heat can also be achieved at an enhanced level as compared to an arrangement in which the conductive member 900 and the medium 501 are positioned away from each other.

Patent Literature 1: Japanese Unexamined Patent Application Publication No. 2014-217989

Patent Literature 2: Japanese Unexamined Patent Application Publication No. 2015-129902

According to an aspect of the present invention, even if a liquid containing a conductive material is used, drying can be performed without causing anomalous heating or sparking.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A drying device comprising:

a dielectric heating unit configured to apply an alternating electrical field to a medium onto which a liquid is applied, and performing dielectric heating of the liquid, the dielectric heating unit including an electrode; and a conductive member that contacts or is close to the medium to which the alternating electrical field is being applied, wherein the medium is in between the electrode and the conductive member, wherein the dielectric heating unit includes a first dielectric heating unit configured to apply the alternating electrical field from side of a first face of the medium, and a second dielectric heating unit configured to apply the alternating electrical field from side of a second face of the medium that is on opposite side of the first face, and wherein the conductive member contacts or is close to the first face of the medium to which the alternating electrical field is being applied by the second dielectric heating unit.

2. The drying device according to claim 1, wherein the first dielectric heating unit heats the liquid in such a way that a solvent remains behind in a predetermined amount.

3. The drying device according to claim 1, wherein the conductive member is a sheet-like member having substantially uniform thickness.

4. The drying device according to claim 1, wherein the conductive member makes contact with the medium and moves along with the medium.

5. The drying device according to claim 4, wherein the conductive member is a belt-type member.

6. The drying device according to claim 1, wherein width of the conductive member is substantially equal to width of the medium.

7. A liquid discharging device comprising:

the drying device according to claim 1; and a discharging unit configured to discharge the liquid onto the medium.

8. A liquid discharging device comprising:

the drying device according to claim 1; and a roller member configured to convey the medium from the first dielectric heating unit to the second dielectric heating unit, and to discharge air from a portion facing the first face.

9. A liquid discharging device comprising:

the drying device according to claim 1; and an auxiliary drying unit configured to, after heating is performed by the second dielectric heating unit, additionally dry the liquid.

10. A drying device comprising:

a dielectric heating unit configured to apply an alternating electrical field to a medium onto which a liquid is applied, and performing dielectric heating of the liquid, the dielectric heating unit including an electrode;

a conductive member that contacts or is close to the medium to which the alternating electrical field is being applied; and a belt member disposed in between the medium and the conductive member disposed close to the medium, the belt member making contact with the medium and with the conductive member, and moving along with the medium.

11. A drying device comprising:

a dielectric heating unit configured to apply an alternating electrical field to a medium onto which a liquid is applied, and performing dielectric heating of the liquid; and a conductive member that contacts or is close to the medium to which the alternating electrical field is being applied, wherein the dielectric heating unit includes an electrode;

a first dielectric heating unit configured to apply the alternating electrical field from side of a first face of the medium; and a second dielectric heating unit configured to apply the alternating electrical field from side of a second face of the medium that is on opposite side of the first face, and wherein conductivity of the conductive member satisfies relationship given in Equation (1):

(conductivity of image formed on the first face after first drying thereof)×(thickness of image formed on the first face after first drying thereof)<(conductivity of the conductive member)×(thickness of the conductive member)<(conductivity of image formed on the second face that is undried)×(thickness of image formed on the second face that is undried) (1)

wherein first drying represents drying performed by the first dielectric heating unit, and wherein image formed on the second face that is undried represents an image formed on the second face that is not yet heated by the second dielectric heating unit.

* * * * *